US011987440B2

(12) United States Patent
Rushin

(10) Patent No.: US 11,987,440 B2
(45) Date of Patent: May 21, 2024

(54) FAN BLADE SHIPPING AND STORAGE BOX

(71) Applicant: UNITED AIRLINES, INC., Chicago, IL (US)

(72) Inventor: William J. Rushin, Greenwood, IN (US)

(73) Assignee: UNITED AIRLINES, INC., Chicago, IL (US)

( * ) Notice: Subject to any disclaimer, the term of this patent is extended or adjusted under 35 U.S.C. 154(b) by 0 days.

(21) Appl. No.: 17/845,923

(22) Filed: Jun. 21, 2022

(65) Prior Publication Data

US 2022/0402688 A1 Dec. 22, 2022

Related U.S. Application Data

(60) Provisional application No. 63/202,658, filed on Jun. 18, 2021.

(51) Int. Cl.

| | |
|---|---|
| ***B65D 85/68*** | (2006.01) |
| ***B65D 25/04*** | (2006.01) |
| ***B65D 43/16*** | (2006.01) |
| ***B65D 81/05*** | (2006.01) |

(52) U.S. Cl.

CPC ..... *B65D 85/68* (2013.01); *B65D 25/04* (2013.01); *B65D 43/166* (2013.01); *B65D 81/058* (2013.01); *B65D 2585/6807* (2013.01)

(58) Field of Classification Search

CPC ..... B65D 25/04; B65D 43/16; B65D 43/166; B65D 81/05; B65D 81/058; B65D 85/68; B65D 2585/6807

See application file for complete search history.

(56) References Cited

U.S. PATENT DOCUMENTS

| | | | | |
|---|---|---|---|---|
| 1,913,649 A * | 6/1933 | White | B65D 85/68 | 206/583 |
| 3,861,531 A * | 1/1975 | Bellati | B65D 81/113 | 206/523 |
| 5,720,094 A * | 2/1998 | Carter | G03G 15/167 | 206/523 |

* cited by examiner

*Primary Examiner* — Bryon P Gehman

(74) *Attorney, Agent, or Firm* — MARSHALL, GERSTEIN & BORUN LLP

(57) ABSTRACT

A storage container for shipping fan blades includes blade compartments each housing one or more fan blades, where each compartment includes an upper foam retention holder that maintains a fan blade tip end in place and a lower foam retention holder that maintains a blade root in place, both holders configured and positioned to prevent twisting or lateral movement of the blades when in the compartment. The compartments form container rows, such that a housing of the storage container has one or more retainer walls that are movable between an access position allowing user access to insert and remove fan blades from compartments and retaining position blocking user access to insert and remove fan blades from compartments.

20 Claims, 21 Drawing Sheets

Isometric View

FAN BLADE SHIPPING AND STORAGE BOX

CROSS-REFERENCE TO RELATED APPLICATIONS

This application claims benefit of the filing date of U.S. provisional patent application No. 63/202,658, filed Jun. 18, 2021, which application is hereby incorporated by reference in its entirety.

FIELD OF THE DISCLOSURE

The present disclosure relates to a shipping and storage container and, in particular, to a shipping and storage container capable of maintaining delicate parts such as fan blades against damage or movement during transit.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Medium and large haul aircraft, such as commercial passenger aircraft, commonly rely on gas turbine engines to propel the aircraft. Gas turbines are typically formed of an upstream rotating gas compressor, a combustor, and a downstream turbine operating on the same shaft as the compressor. Different gas turbine engines may be distinguished by their size and the number of compressors and turbine sections, all arranged coaxially. These compressor and turbine sections are divided into stages. A compressor section is formed of a series of fan and compressor blades fitted around a rotor having a shaft. Different engines and different engine sections may be formed of fan blades of different size and shape. Each blade in a gas turbine engine for an aircraft is characterized by a blade section and a root section. The root sections of the fan blades are where the blades are made to fit around the rotor that controls rotational movement. The curved blade sections extend from the root and provide surfaces for gas intake and compression to affect operation.

Fan blades are efficient, steady, and robust, cycling many hours of testing before deployment into engines and aircraft for operation. Yet, proper transportation of fan blades is a challenge. Fan blades are susceptible to damage during transportation if, for example, they come into impact contact with other fan blades or other metal structures. The thin blade sections are susceptible to damage if exposed to sufficient twisting force or even to sufficient lateral force. Furthermore, the extent of such damage may involve machine vision or other dedicated analysis techniques to determine if any damage has occurred. Add to that, not only are fan blades transported for assembly purposes, in some instances worn fan blades are removed from engines and transported for wear, strain, and fatigue analysis. In such situations, it is additionally important to maintain the integrity of the fan blade to avoid any alteration to the blade post disassembly to ensure proper analysis of operational wear, strain, and fatigue analysis.

SUMMARY OF THE INVENTION

In accordance with an implementation, a storage container comprises: a housing defining a plurality container rows, each row having a plurality of compartments each for housing a fan blade comprising a blade tip end and a blade root end, the plurality of container rows being parallel to one another and extending along a longitudinal axis of the storage container; each of the plurality of compartments comprising compartment walls separating from the compartment from adjacent compartments, and each of the plurality of compartments having a first retention holder having a receptacle slot shaped to retain the blade tip in place at a first end of the compartment and a second retention holder having a receptacle slot shaped to retained the blade root end in a second end of the compartment, wherein at least one of the first retention holder and the second retention holder is removable from the compartment, wherein each of the first retention holder and the second retention holder have a press fit against the compartment walls when retaining a fan blade in place and against lateral movement within the compartment and against twisting movement within the compartment; the housing further comprising a plurality of retainer walls each spanning a respective container row and each movable between an access position allowing user access to insert and remove fan blades and retaining position blocking user access to insert and remove fan blades; and a container lid forming a press fit with the housing to retain the fan against transverse movement out of the housing during transportation of the storage container.

In an example, the plurality of retainer walls are each formed of a continuous wall member spanning the respective container row.

In an example, the plurality of retainer walls are in a hinged configuration having one or more hinges allowing for movement between the access position and the retaining position.

In an example, the plurality of retainer walls are flush with end walls of the housing when in the retaining position.

In an example, the hinges are butterfly hinges.

In an example, the hinges are magnetic hinges.

In an example, the storage container further comprises one or more latches to retain the plurality of retainer walls in the retaining position.

In an example, the plurality of retainer walls each comprise a fixed wall extending transversely from the first end of the compartments and movable wall connected to the fixed wall and movable between the access position and the retaining position.

In an example, the plurality of retainer walls are formed of a plurality of wall members spanning the respective container row.

In an example, each of the first retention holder and the second retention holder are formed of a dense foam.

In an example, the receptacle slot of the first retention holder extends the transverse length of the first retention holder and the receptacle slot of the second retention holder extends the transverse length of the second retention holder.

In an example, the receptacle slot of the first retention holder partially extends the transverse length of the first retention holder and is capped with a stopping wall of the first retention holder and the receptacle slot of the second retention holder partially extends the transverse length of the second retention holder and is capped with a stopping wall of the second retention holder.

In an example, the respective first retention and second retention holders in compartments within a container row are positioned to retain the respective fan blades in substantially the same orientation.

In an example, the respective first retention and second retention holders in the plurality of containers row are positioned to retain the respective fan blades in substantially the same orientation in the storage container.

In an example, both the first retention holder and the second retention holder are removable from compartments.

In an example, the storage container further comprises one or more container lid latches to retain the container lid in engagement against the housing.

In an example, the container lid forms the press fit with the housing by forming the press fit with end walls of the housing.

In an example, the container lid has a spacing gap to the plurality of retainer walls.

In an example, the container lid comprises an deformable insert layer contacting an upper edge of the compartment walls.

In an example, the compartment walls and the plurality of retainer walls are formed of % inch plywood or other composite materials.

BRIEF DESCRIPTION OF THE DRAWINGS

The figures described here depict various aspects of the system and methods disclosed herein. It should be understood that each figure depicts an embodiment of a particular aspect of the disclosed system and methods, and that each of the figures is intended to accord with a possible embodiment thereof. Further, wherever possible, the following description refers to the reference numerals included in the following figures, in which features depicted in multiple figures are designated with consistent reference numerals.

DETAILED DESCRIPTION

The present techniques include fan blade shipping and storage containers and, in particular, containers configured to maintain fan blades in place and intact against damage. Fan blades, while designed to withstand intense operating conditions and to maintain structural integrity over their lifetime, are susceptible to damage and require frequent inspection. A fan blade typically has a root section that is mounted to a rotor or other hub. A series of fan blades, for example, will have their root sections mounted to a rotor disk of an aircraft engine. Extending from each root section is the blade portion, also termed an airfoil, which is designed with particular geometries (e.g., thickness, curvature, taper, etc.) to convert airflow into energy during turbine engine operation. Often it is desirable to transport a series of fan blades to an inspection service or for some other purpose. Yet, any contact with these fan blades, especially to the blade portion can damage the ran blade, especially where that contact is with another fan blade or any object of a particular density, hardness, etc. The present techniques, however, provide for shipping and storage containers that isolate fan blades from one another during transportation, maintain the fan blades in a fixed positioned against twisting movement, side impact, end-on impact, and the like, which allowing for easy access to insert and remove each fan blade individually.

In some examples, the present techniques provide a storage container that includes a housing defining a plurality container rows, each row having a plurality of compartments, where each is to house a fan blade comprising a blade tip end and a blade root end, the plurality of container rows being parallel to one another and extending along a longitudinal axis of the storage container. In some examples, the storage container further may include each of the plurality of compartments having compartment walls separating from the compartment from adjacent compartments, and each of the plurality of compartments having a first retention holder having a receptacle slot shaped to retain a curved blade tip in place at a first end of the compartment and a second retention holder having a receptacle slot shaped to retained the blade root end in a second end of the compartment. In some examples, for the storage container, at least one of the first retention holder and the second retention holder is removable from the compartment, wherein each of the first retention holder and the second retention holder have a press fit against the compartment walls when retaining a fan blade in place and against lateral movement within the compartment and against twisting movement within the compartment. The storage container may further include a container lid forming a press fit with the housing to retain the fan blades against transverse movement out of the housing during transportation of the storage container.

Figure 1:
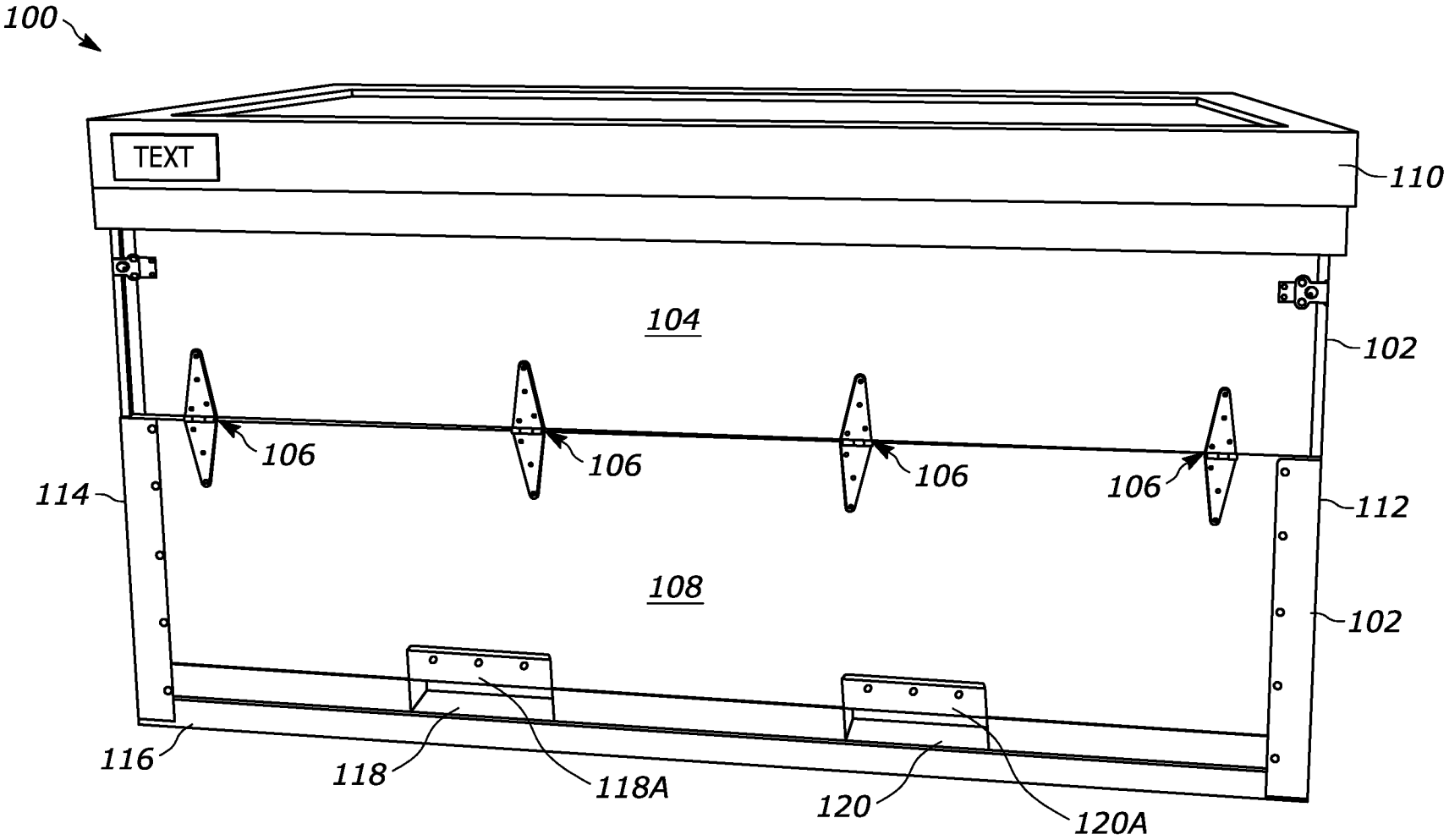
FIG. 1 is a perspective view of a fan blade storage container with container lid in place, in accordance with an example.

FIG. 1 is a side view of a storage container 100 showing housing 102 and, in particular, a side of the longitudinal side of the housing showing a retainer wall 104 with hinges 106 that allow the retainer wall 104 to be moved between an access position (not shown) and a retaining position (shown). The retainer wall 104 is thereby hinged to fixed wall 108 of the housing 102, such that the retainer wall 104 may be rotated from the upward retaining position shown in FIG. 1 to a downward access position shown in FIG. 2. The hinges 106 are butterfly hinges in some examples, although any suitable types of hinges may be used including magnet hinges that provide for rotation and rely on magnetic forces to maintain retain walls in one or more of the retaining position and the access position.

Figure 9:
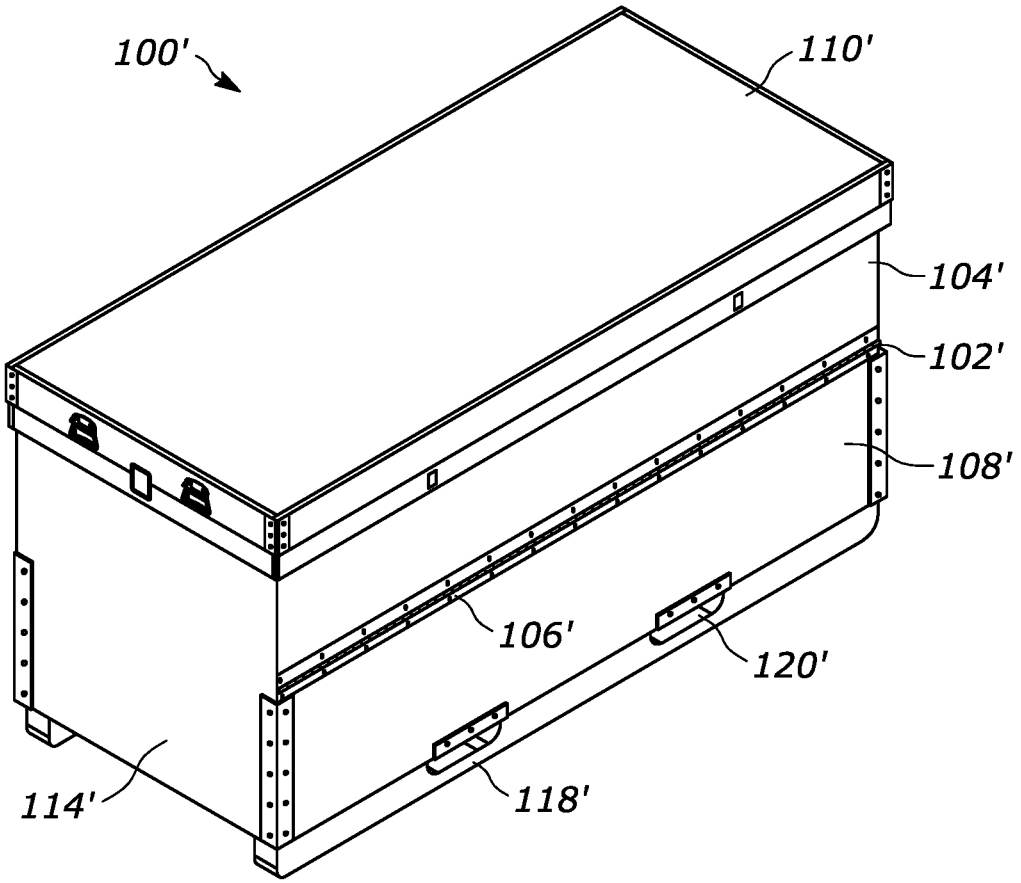
FIG. 9 is a perspective view of another example storage container, in accordance with an example.
Figure 10:
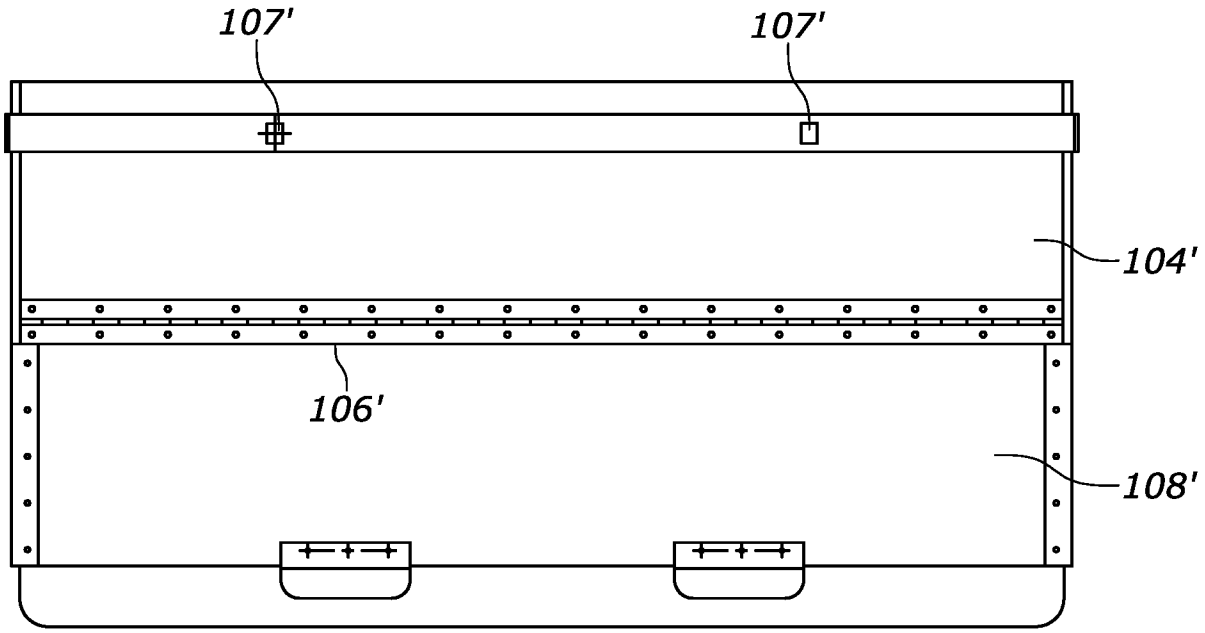
FIG. 10 is a side view of the storage container of FIG. 9, in accordance with an example.

A container lid 110 is shown in place forming a press fit with the housing 102 in particular with the retainer wall 104 and two fixed side walls 112 (see, FIG. 2) and 114 (see, FIG. 2) to retain the fan blades against transverse movement out of the housing 102 during transportation of the storage container 100. Positioned above a base plate 116 of the housing 102 are two carrier slots 118 and 120 which are sized, in width and length, to receive standard dimensions lifters, such as forks of a forklift, including extendable forks mounted to a lift cylinder, tilt cylinder, etc. The slots may have guard flanges 118A and 120A respectively to deflect an oncoming fork downward into the respectively slot, if needed, as well as to provide a protective edge against damage. Guard flanges 118A and 120A may be formed of a metal or other hardened material to prevent or limited impact damage. FIGS. 9 and 10 illustrate another example storage container 100' similar to that of the container 100 having a housing 102', a retainer wall 104', a fixed wall 108', a side wall 114', and two carrier slots 118' and 120' each similar to the corresponding feature of the container 100. The container 100' differs from the container 100, however, via the use of a continuous hinge 106' in the former to allow for the retainer wall 104' to rotate between access and retaining positions. As shown in FIG. 10, the retainer wall 104' may include one or more recessed pull handles 107' that allow a user to move the wall between access and retainer positions. Similarly, the retainer walls 104 and 105 may have such features. The retainer walls 104 and 105 may be each a continuous wall spanning the entire length of the container 100 and thus an entire row of compartments. In other examples, the retainer walls 104 and 105 may be formed of multiple wall segments which may be each individually movable between retaining position and an access position.

Figure 2:
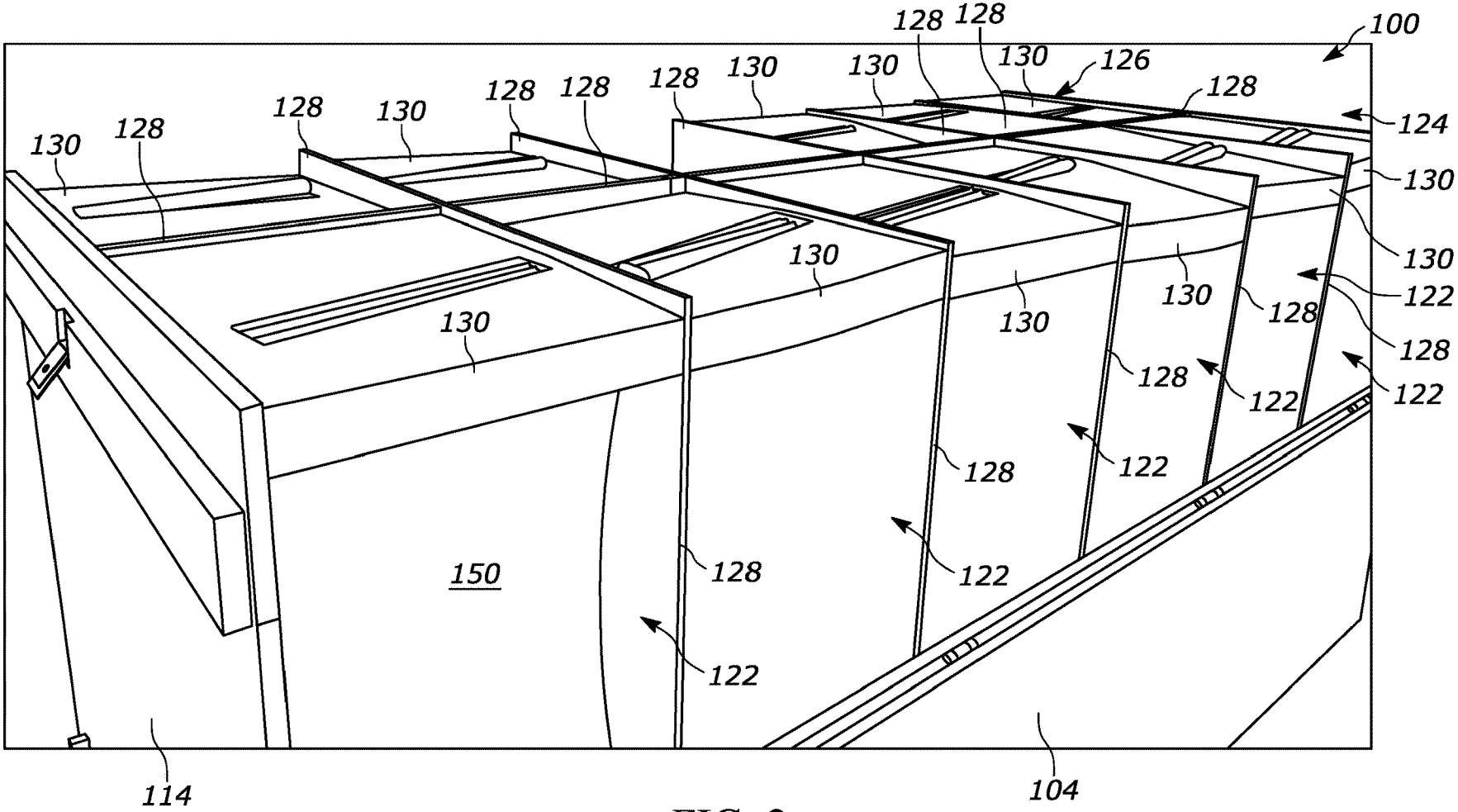
FIG. 2 is a perspective view of the fan blade storage container of FIG. 1 showing a row of compartments each of which include a fan blade retained by retention holders, in accordance with an example.
Figure 3:
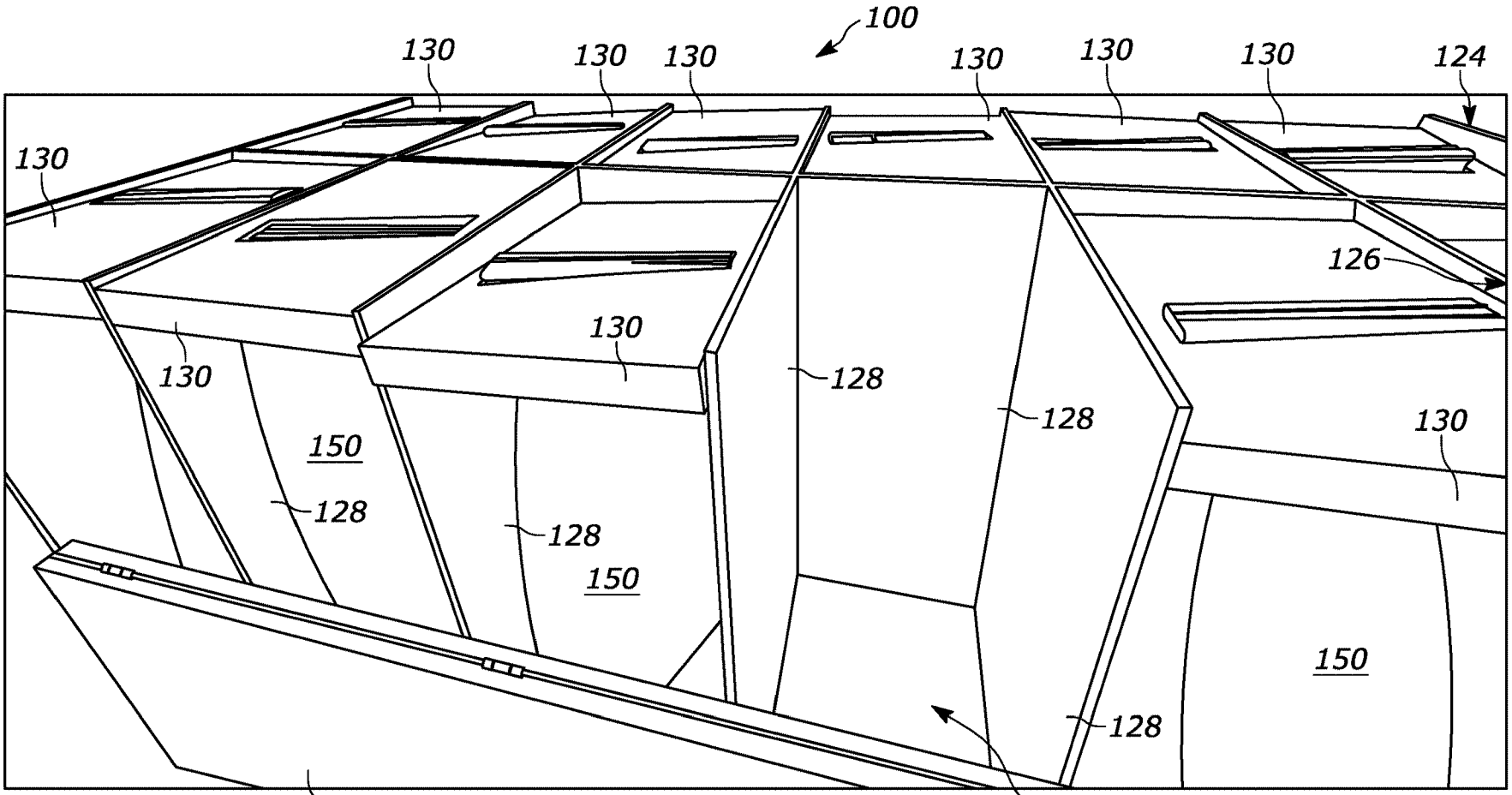
FIG. 3 is perspective view of another side of the fan blade storage container of FIGS. 1 and 2 showing a different row of compartments of fan blades, in accordance with an example.

FIG. 2 illustrates the container 100, with the lid 110 removed and with the retainer wall 104 rotated into an access position to expose a plurality of compartments 122, each to house a separate fan blade. In the illustrated example, there are six (6) compartments 122 forming a first container row 124 and another 6 compartments 122 forming a second container row 126. The retainer wall 104 spans the length of the container row 124. Compartments 122 are separated by compartment walls 128 that extend from a bottom of the housing 102 upwards to define a mounting plane upon which an inner surface of the lid 110 can be mounted or other retaining member. The compartment walls 128 may formed of plywood or other composite materials. In the example container 110, each compartment 122 is to include two removable retention holders, one retention holder (not shown) at a lower portion of compartment 122 and another retention holder 130 at an upper end. FIG. 3 illustrates the container rows 124 and 126 from the opposite side and showing that one of the compartment slots 122D does not have retention holder 130 (or the lower retention holder 132). Each of the retention holders is sized to have a press fit with the compartment walls 128 to retain the retention holders in place and against lateral or transverse movement within the compartment slot 122. A second retainer wall 105 spans the container row 126. In various examples, the retainer wall 105 is essentially identical to the retainer wall 104, but on the opposite side of the housing. For example, the retainer wall 105 may have hinges that allow the retainer wall 105 to be moved between an access position (shown in FIG. 3) and a retaining position (not shown).

Figure 4:
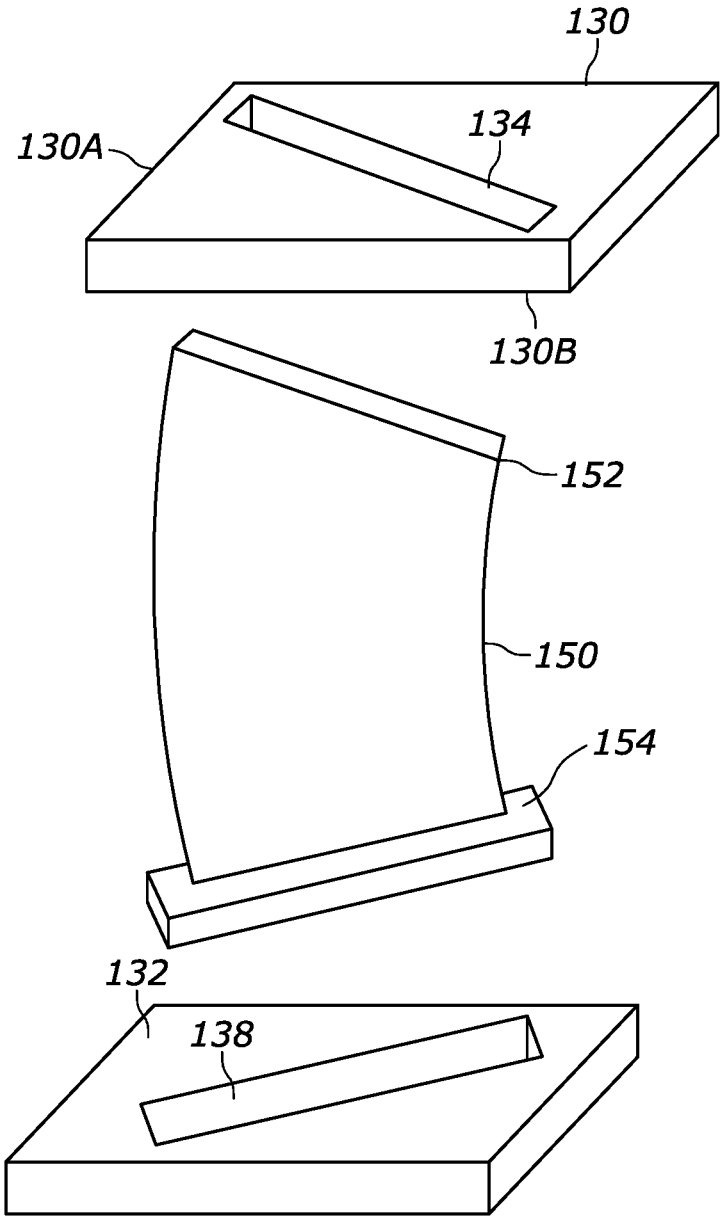
FIG. 4 is a perspective view of a retention holder for a fan blade tip end and another retention holder for a fan blade root end and showing an example fan blade, in accordance with an example.
Figure 5A:
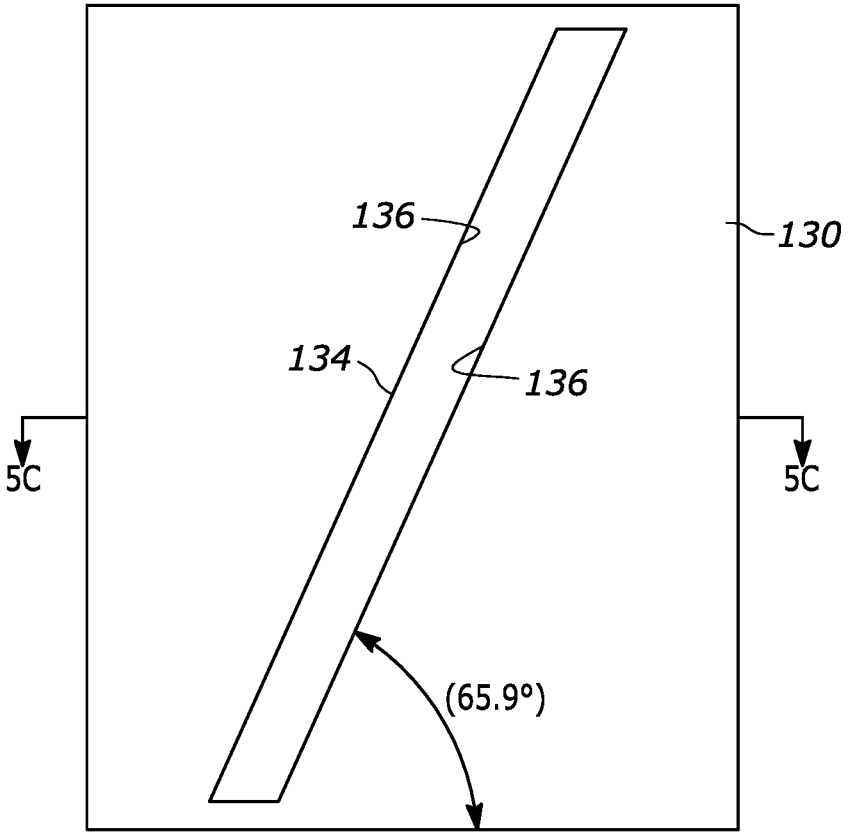
FIG. 5A is a top view of the fan blade tip end retention holder of FIG. 4.
Figure 5B:
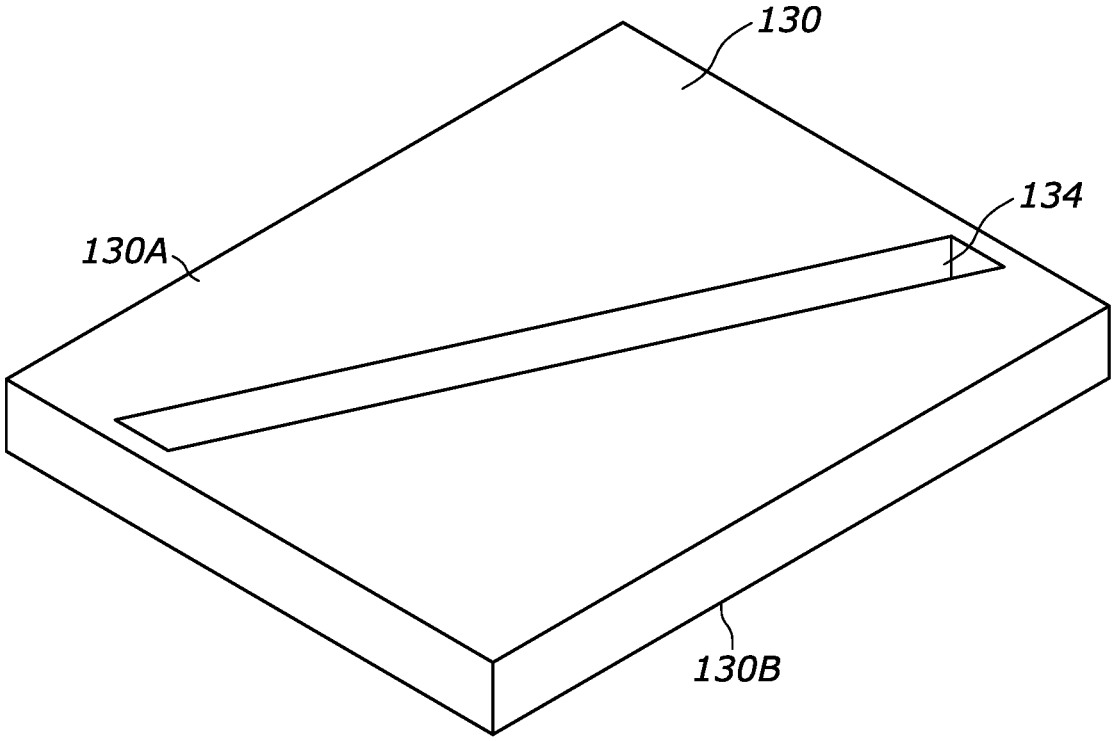
FIG. 5B is a perspective view of that retention holder.
Figure 5C:
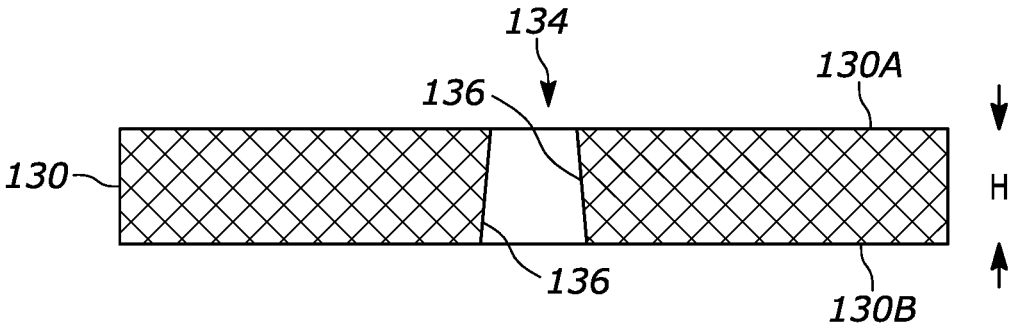
FIG. 5C is a cross-sectional view of that retention holder, in accordance with an example.

FIG. 4 illustrates an upper retention holder 130 and a lower retention holder 132. In illustrated example, the upper retention holder 130 has a receptacle slot 134 shaped to retain a tip end of a fan blade 150, more particularly, a tip end of a blade portion 152 (also termed a blade tip end) thereof. Fan blades can be very complex shapes having a continuous twist with an aerodynamic curve that extends from the bottom, root portion of the blade to the tip. The exact geometric shape of the curve may vary between different types of fan blades, for example, for different types of turbine engines. The receptacle slot 134 is shaped and dimensioned to retain the tip end of a fan blade with applying undue forces on the blade. In the illustrated example, the slot 134 is rectangular in shape and dimensioned to retained the curved blade tip end with a press fit without apply undue forces on the blade tip end and a secure fit to retain the blade tip end. In other examples, the receptacle slots herein may be curved to exactly match or nearly match the curvature of the blade tip end. The receptacle slot 134 may extend from an upper surface 130A of the holder to a lower surface 130B and be sized based on the width and length of the tip end to maintained a press fit with the tip end. FIGS. 5A, 5B, and 5C illustrate a top view, a perspective view, and a cross-section view of the retention holder 130, respectively. As shown, in some examples, inner walls 136 of the slot 134 are tapered from the lower surface 130B to the upper surface 130A to further prevent the holder 130 from resting further down the blade portion 152 and from having the tip of the blade protruding above the upper surface 130A. The holder 130 height, the dimensions of the slot 134, and/or the taper of the slot 134 may be chosen to ensure that no portion of the blade portion 152 extends above the upper surface 130A so as to be fully protectable against any impact. In some examples, a flexible sealing strip is attached to each inner wall 136 and is configured to engage of a respective surface of the blade portion 152. The strip, which may be formed of rubber or some other flexible material, is able to create a further press fitting to maintain the tip of the blade portion 152 in the slot 134.

Figure 7A:
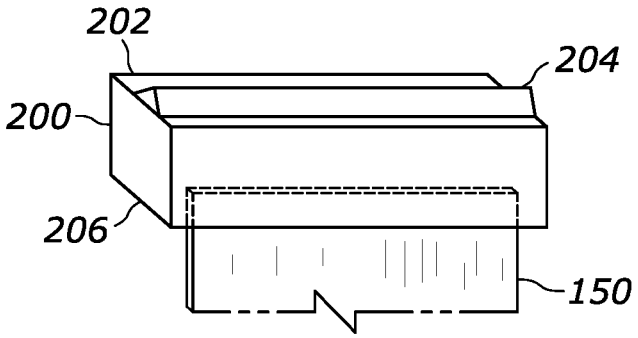
FIG. 7A is perspective view of a protective sealing cap that may be used to further protect a blade tip end.
Figure 7B:
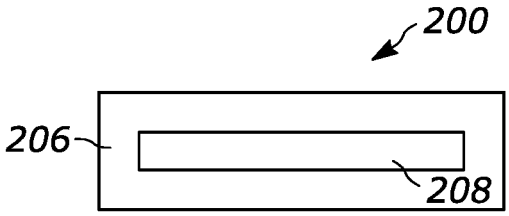
FIG. 7B is a bottom view of that sealing cap, in accordance with an example.

In some examples, a protective sealing cap, which may be rubber or some other flexible material, is placed on the tip of the blade portion 152 and configured to set within the slot 134 to retain the tip in a fixed position relative to the slot 134. An example protective sealing cap 200 is shown in FIGS. 7A and 7B, sized to fit within the slot 134. The sealing cap 200 has an upper surface 202 protecting the blade 150 against end compression forces and impact and may in some examples include a protective protrusion 204 (or any other protective dampening member). An inner surface 206, shown in FIG. 7B includes a slot 208 for receiving the blade portion 152. That slot 208 may be rectangular like that of slot 134 or the slot 208 may be curved. Thus, the sealing cap 200 may be configured to provide a shape conversion, for example, by accepting a curved tip of the blade portion 152 into slot and have a rectangular outer surface to fit within a rectangular slot.

Figure 6A:
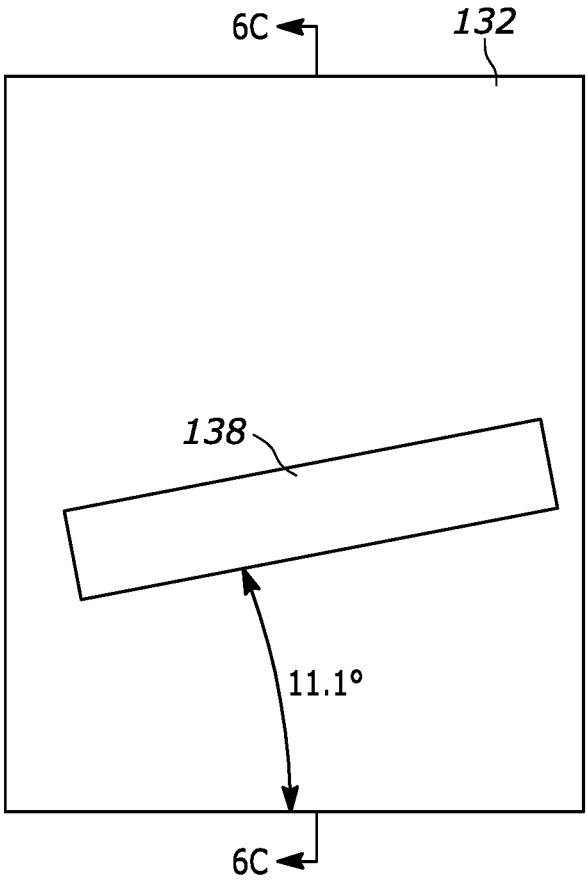
FIG. 6A is a top view of the fan blade root end retention holder of FIG. 4.
Figure 6B:
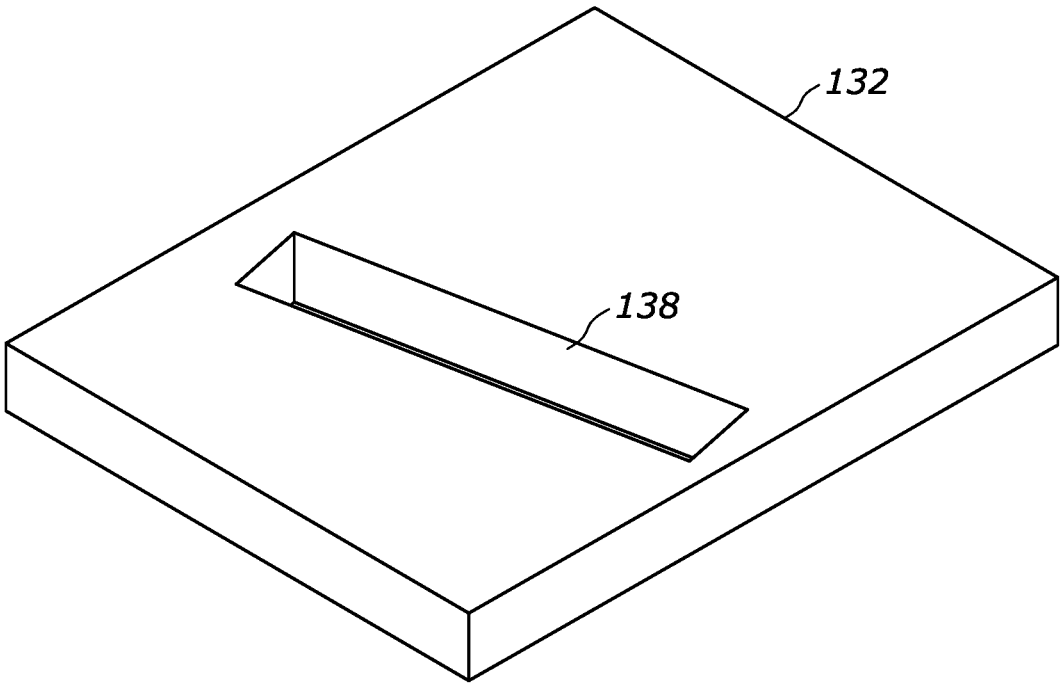
FIG. 6B is a perspective view of that retention holder.
Figure 6C:
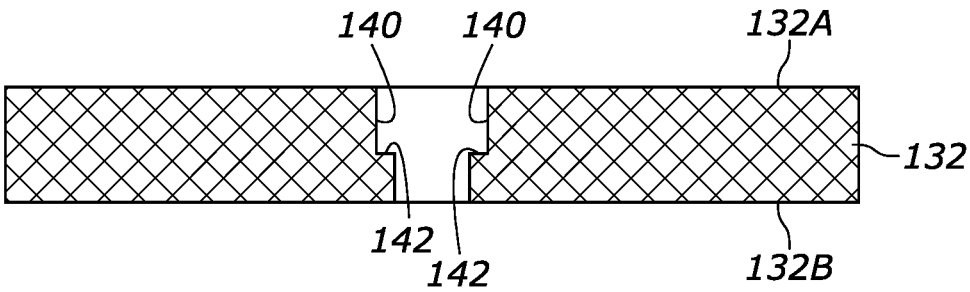
FIG. 6C is a cross-sectional view of that retention holder, in accordance with an example.

The lower retention holder 132 is configured to retain the blade root section 154 (also termed a blade root end). FIGS. 6A, 6B, and 6C illustrate a top view, a perspective view, and a cross-section view of the retention holder 132, respectively, showing a slot 138 into which the root section 154 is to sit. In some examples, inner walls 140 of the slot 138 are shaped based on the shape of the root section 154. In some examples, the inner walls 140 may extend as a planar wall from an upper surface 132A to a lower surface 132B. In some examples, including the example of FIG. 6C, the inner walls 140 may have indented shape to provide a seating 142 within which the root section 154 may sit. The holder 132 height, the dimension of the slot 138, and/or the shape of inner walls 140 may be all chosen to ensure that no portion of the root section 152 extends above the upper surface 130A so as to be fully protectable against any impact.

Figure 8:
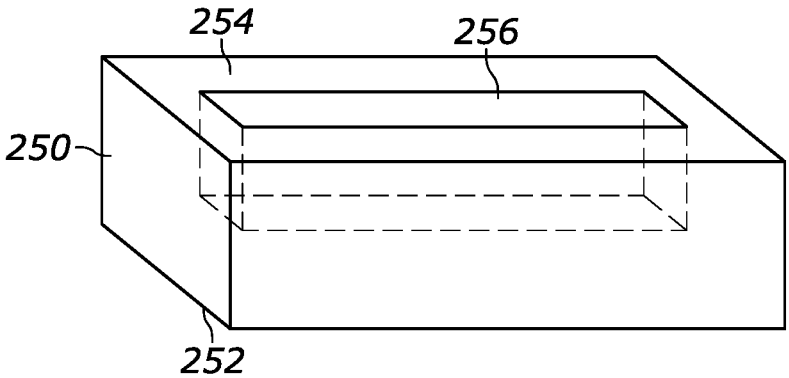
FIG. 8 is a perspective view of a protective sealing cap for fan blade root end, in accordance with an example.

In some examples, a protective sealing cap, which may be rubber or some other flexible material as well, is placed on root section 154 and configured to set within the slot 138 to retain the root section 154 in a fixed position relative to the slot 138. FIG. 8 illustrates a sealing cap 250 for a root section and having an upper surface 252 and an inner surface 254 having a slot 256 for retaining the blade root section 154. The terms upper and inner are generally made here to connote the relationship of the sealing caps to the respective blade portions themselves.

As shown in various figures, depend on the shape and curvature of the fan blade 150, the slots 134 and 138 can be oriented in their respective holders and quite different angles. Examples orientation angles are shown as 65.9° for the slot 134 and 11.1° for the slot 138, although these are provided merely as examples. The respective orientation angles differ because of the curvature of the fan blades from the root end to the blade tip end, where the amount of curvature may determine the differences between these orientation angles.

In various examples, the retention holders 130 and 132 are formed of a dense foam, such as an ethafoam, closed-cell foam, rebond foam, polyurethane foam, polyether foam, polyester foam, closed-cell sponge rubber, or open-cell sponge rubber. The retention holders 130 and 132 are preferably formed a continuous foam material, from an upper surface to a lower surface, and continuous along the internal walls of respective slots. Such configurations can, in some examples, help ensure uniform retention of the blade in the holders and uniform protection of the blade portions from external forces, in comparison to attempting to use a layered cardboard or corrugated fiberboard or other heavy paper medium based structures. Such structures are poor at maintaining uniform force along all contacts onto a blade portion.

Figure 11:
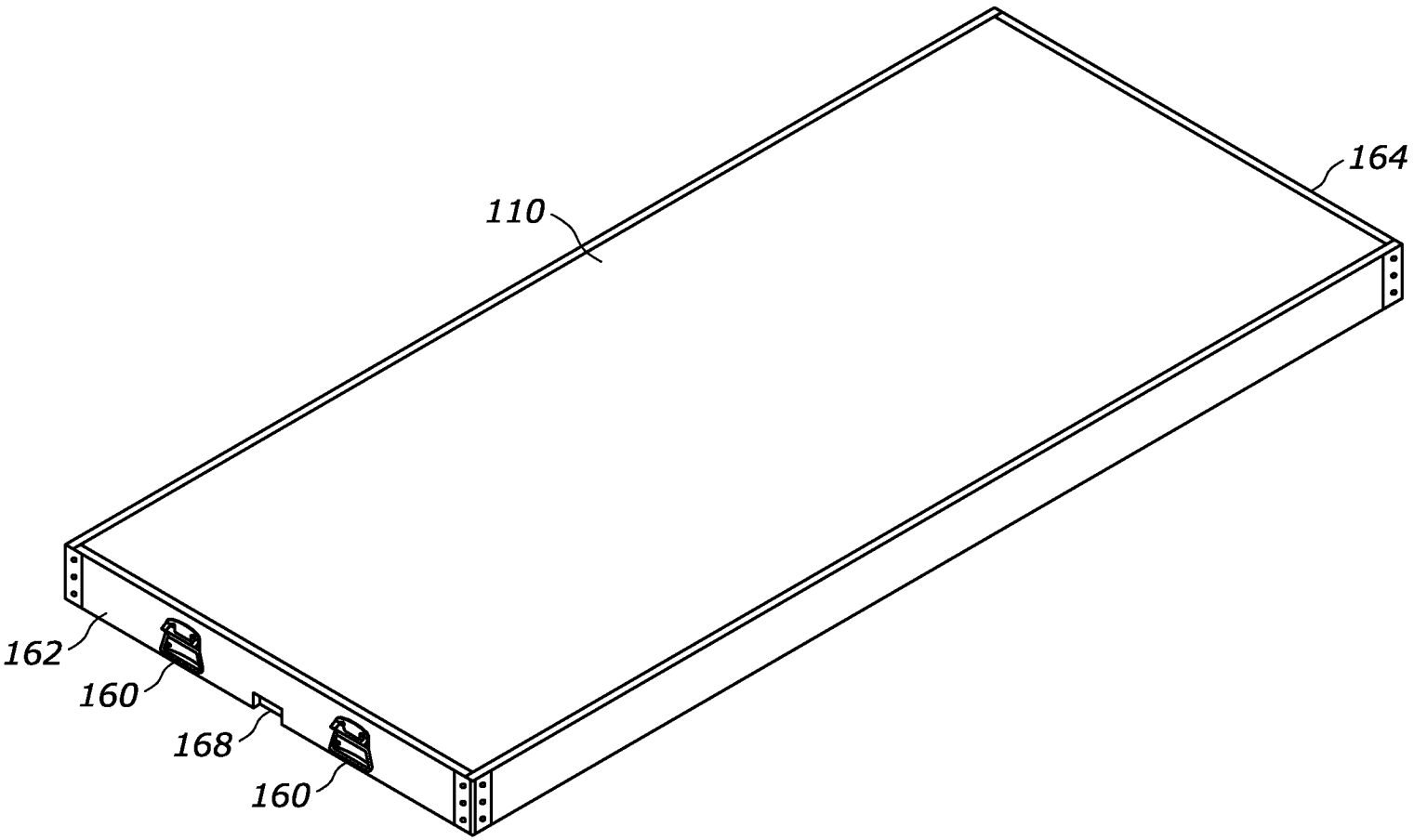
FIG. 11 is top perspective view of a container lid as may be used with the storage container of FIG. 1, in accordance with an example.
Figure 12:
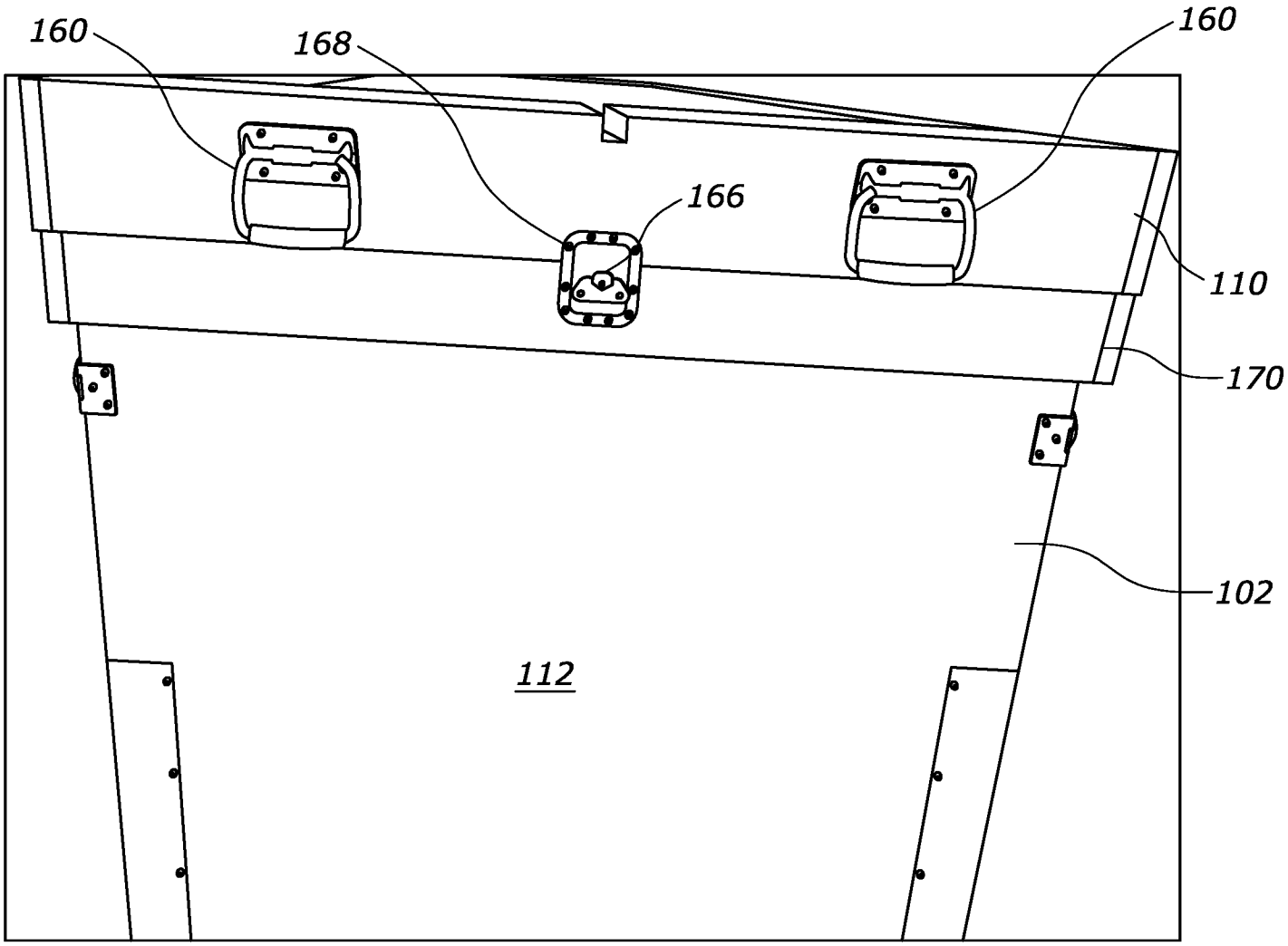
FIG. 12 is side perspective view of a container lid in place on the storage container of FIG. 1, in accordance with an example.

FIG. 11 illustrates the container lid 110 showing two handles 160 at each of two ends 162 (shown) and 164 (not shown). FIG. 12 illustrates a side view of the container lid 110 attached to a side of the housing 102, where a latch 166 positioned on the housing side wall 112 is shown. The latch 166, which may be formed in an upper rim portion 170 of the housing 102, forms a locked engagement with a latch receptor 168 on the container lid 110. That locked engagement may be a snap lock or click lock engagement the fixedly retains the container lid 110 on top of the housing 102, until an operator releases the locked engagement. In some examples, the locked engagement may be a screw engagement or other engagement. In some examples, the latch 166 may include an access control, such as a key access to prevent unauthorized users from unlocking the latch 166.

Figure 13A:
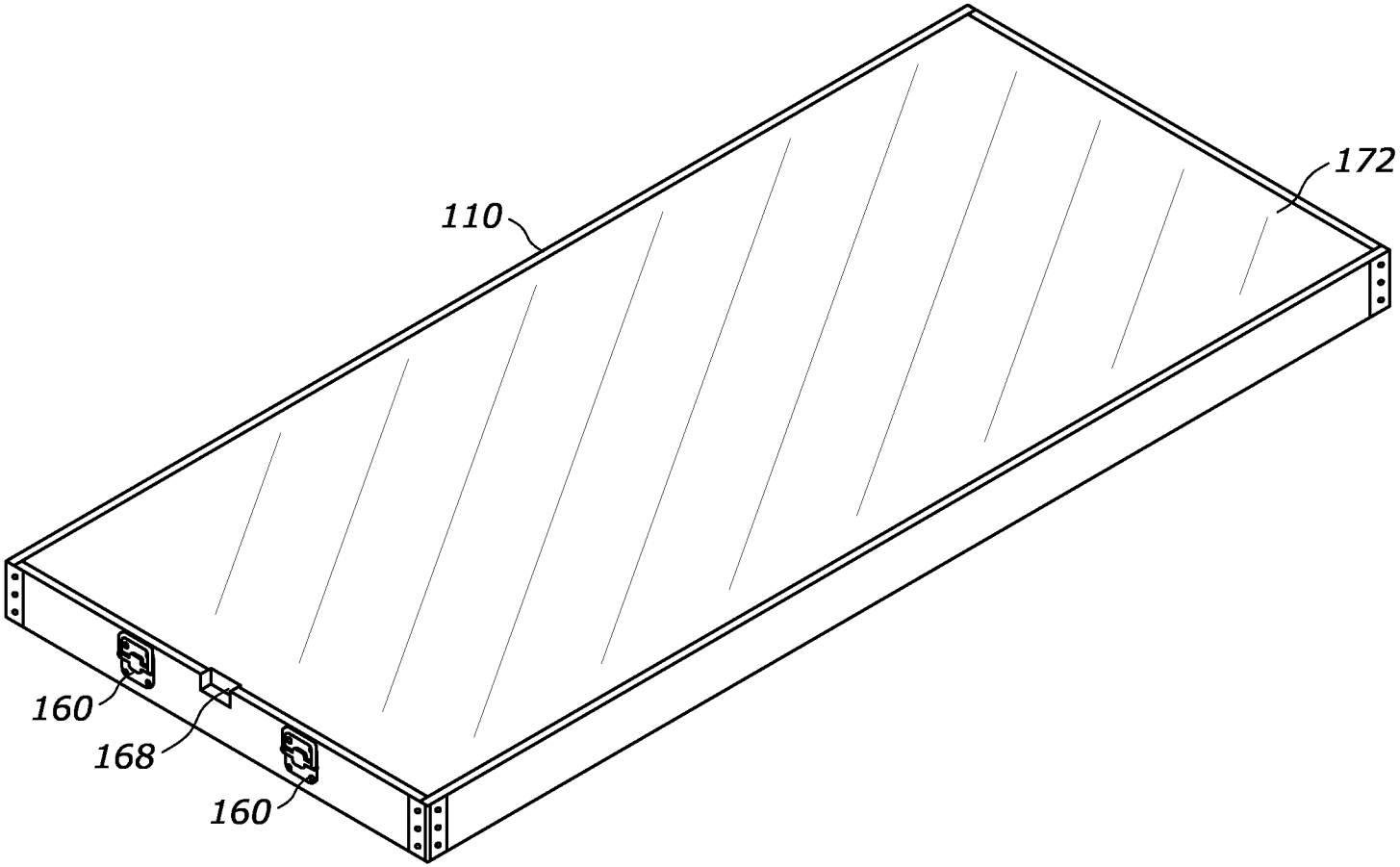
FIG. 13A is an underneath perspective view of the container lid of FIG. 11, in accordance with an example.
Figure 13B:
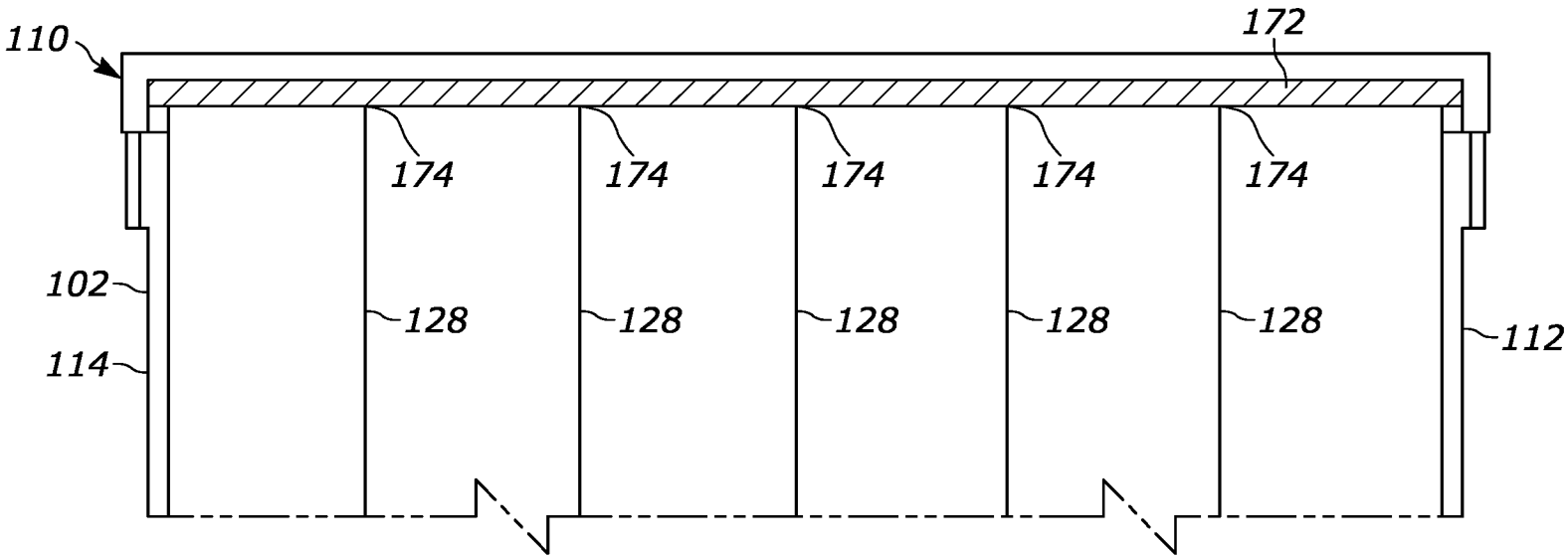
FIG. 13B is a cross sectional view of a container lid in a retaining position on the storage container, in accordance with an example.

FIG. 13A illustrates in inner surface of the container lid 110 and shown an optional deformable insert layer 172 that spans the entire inner surface of the container lid 110 and that contacts upper edges 174 of compartment walls 128 to form a press fit when the container lid 110 is latched in place to the housing 102. In some examples, the insert layer 172 may be formed with receiving slots patterned and sized to receive upper edges of each of the compartment walls, transversely extending compartment walls such as those shown in FIG. 13B and latterly extending compartment walls, not shown. In some examples, there is a gap between the compartment wall upper edges and the insert layer or optionally when the inner surface of the container lid 110 has no insert layer. In some examples, the container lid 110 forms a spacing gap to an upper edge of each of the plurality of retainer walls.

Figure 18:
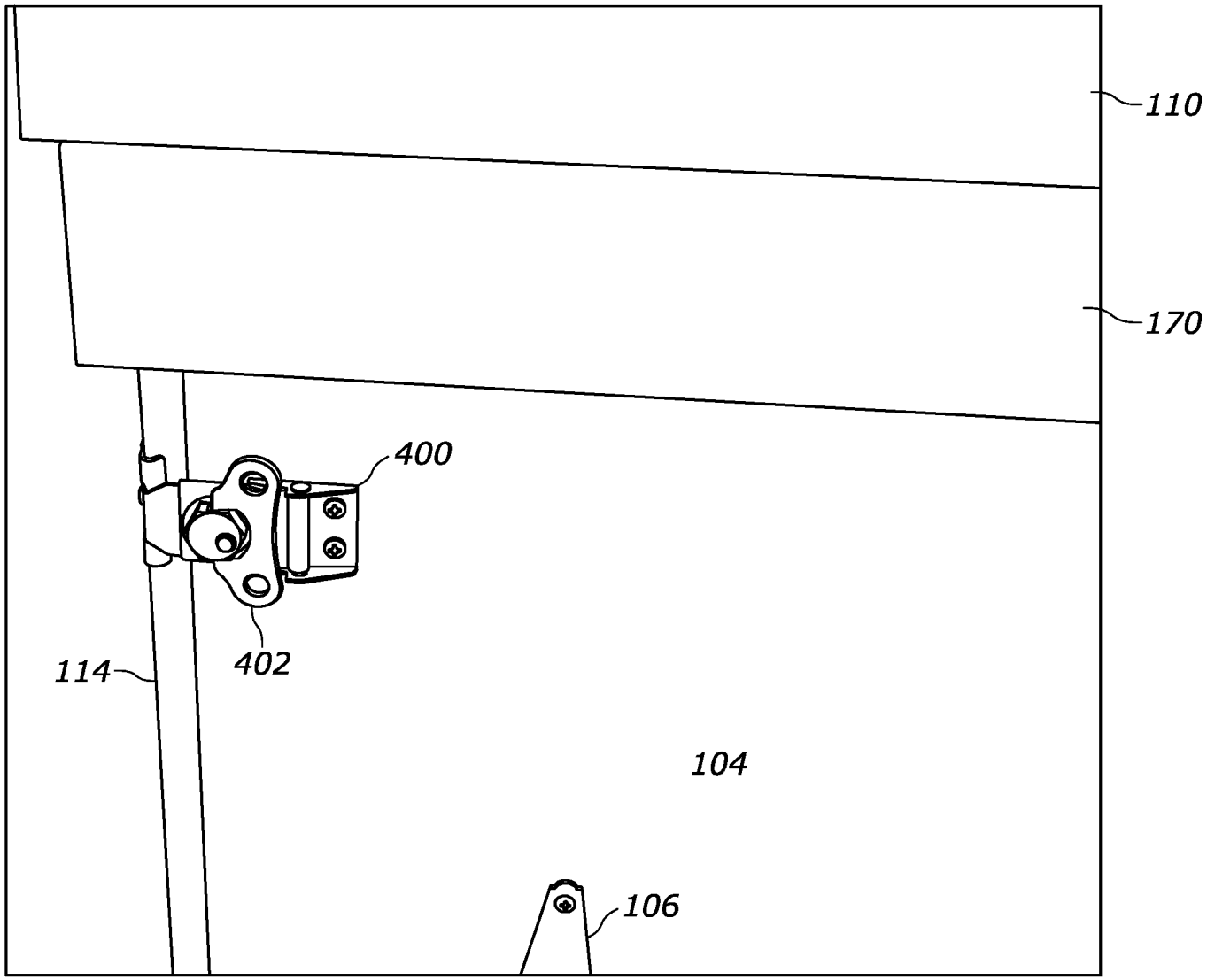
FIG. 18 is a perspective view of a retainer wall of the storage container of FIG. 1, in accordance with an example.

The movable retainer walls 104, 105 may be held in place against rotation by the container lid 110 once latched to the housing. In some examples, these walls may be latched in place. FIG. 18 illustrates retainer wall 104 having a latch receptor 400 engaged by a latch 402 mounted to the side wall 114. Any number of locking mechanisms may be used to retain the retainer walls into the retaining position. Each side wall of the housing may have one or more latches for connecting to one or more latch receptors on each movable retainer wall, so that the walls are latched on both ends. As shown in FIG. 18, in various embodiments, the retainer wall 104 is flush with an end wall 114, as would be the case for other retainer walls and both end walls.

Figure 19:
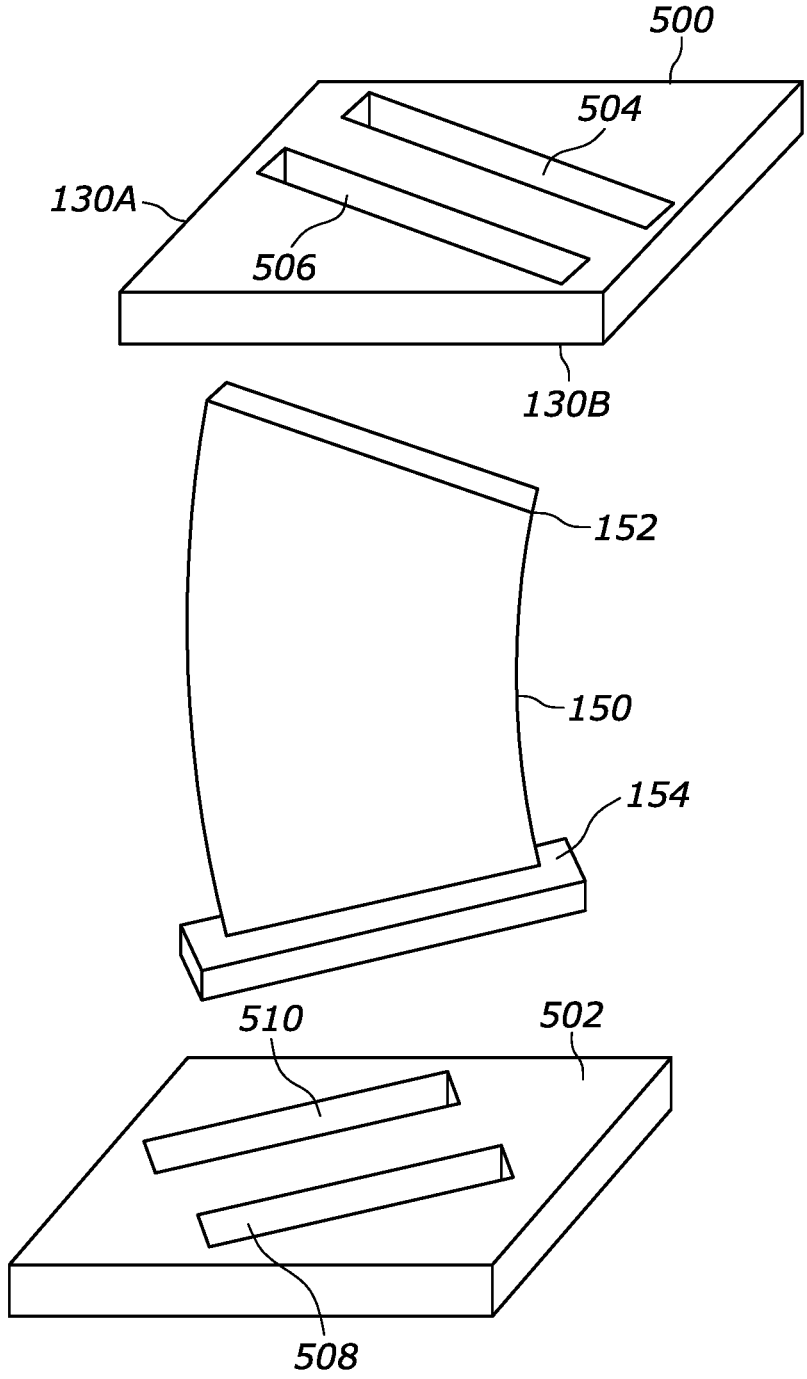
FIG. 19 is a perspective view of another pair of retention holders capable of retaining two fan blades in a single compartment, in accordance with an example.

FIG. 19 shows retention holder pairs 500 and 502 for retaining two fan blades in same compartment, with the retention holder 500 having two slots 504 and 506 for accepting a blade end portion or sealing caps thereof and the retention holder 502 having two slots 508 and 510 for accepting corresponding blade root portions or sealing caps thereof. In some examples, any of the retention holders herein may be formed with integrated stopping walls. These stopping walls provide caps for the respective slots. The stopping walls may be integrated into the retention holder, for example, by being formed of the same material as the rest of the holder. They provide a protective cap that prevents on axis impact or forces applied blade tip portion or the blade root portion.

Figure 14:
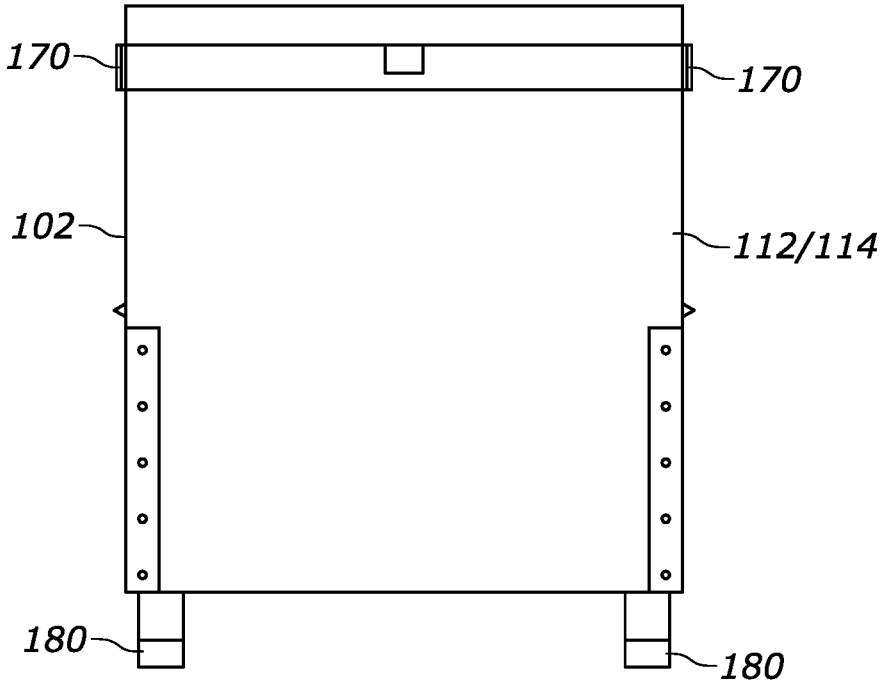
FIG. 14 is a side view of the storage container of FIG. 1 without the container lid, in accordance with an example.
Figure 15:
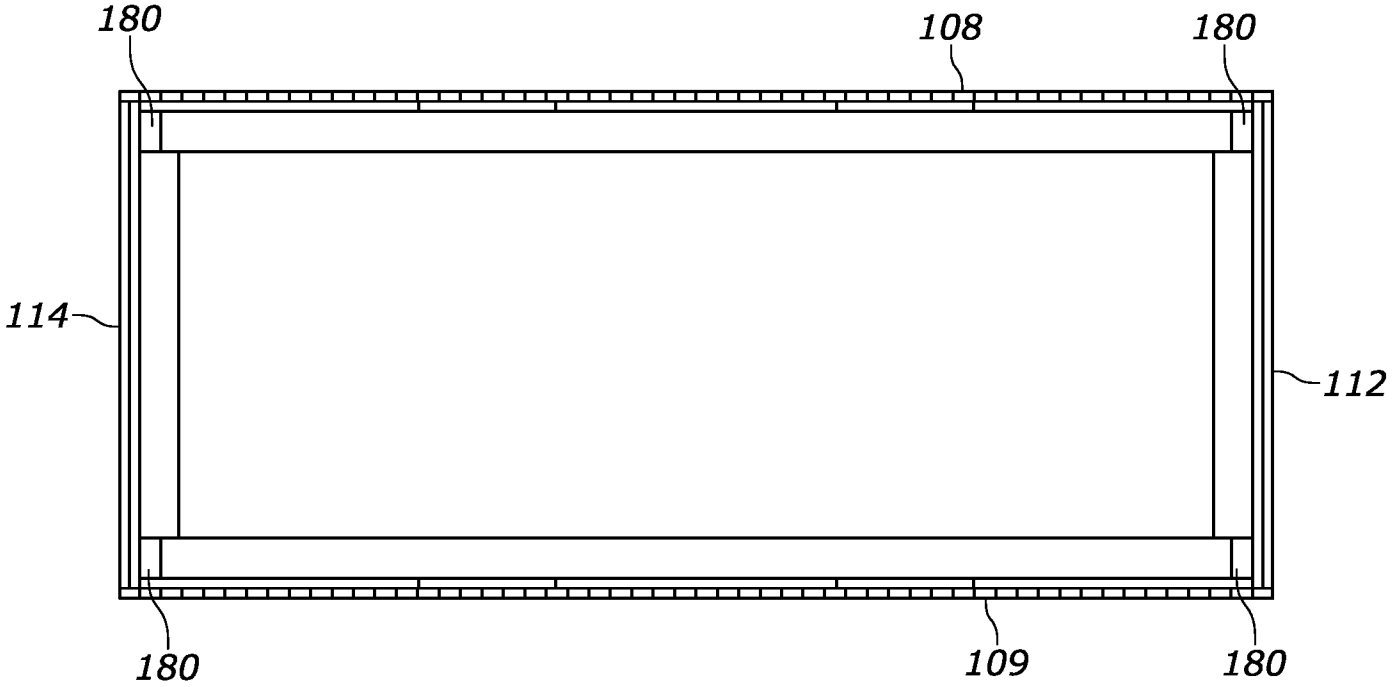
FIG. 15 is a bottom view of the storage container of FIG. 1, in accordance with an example.
Figure 16:
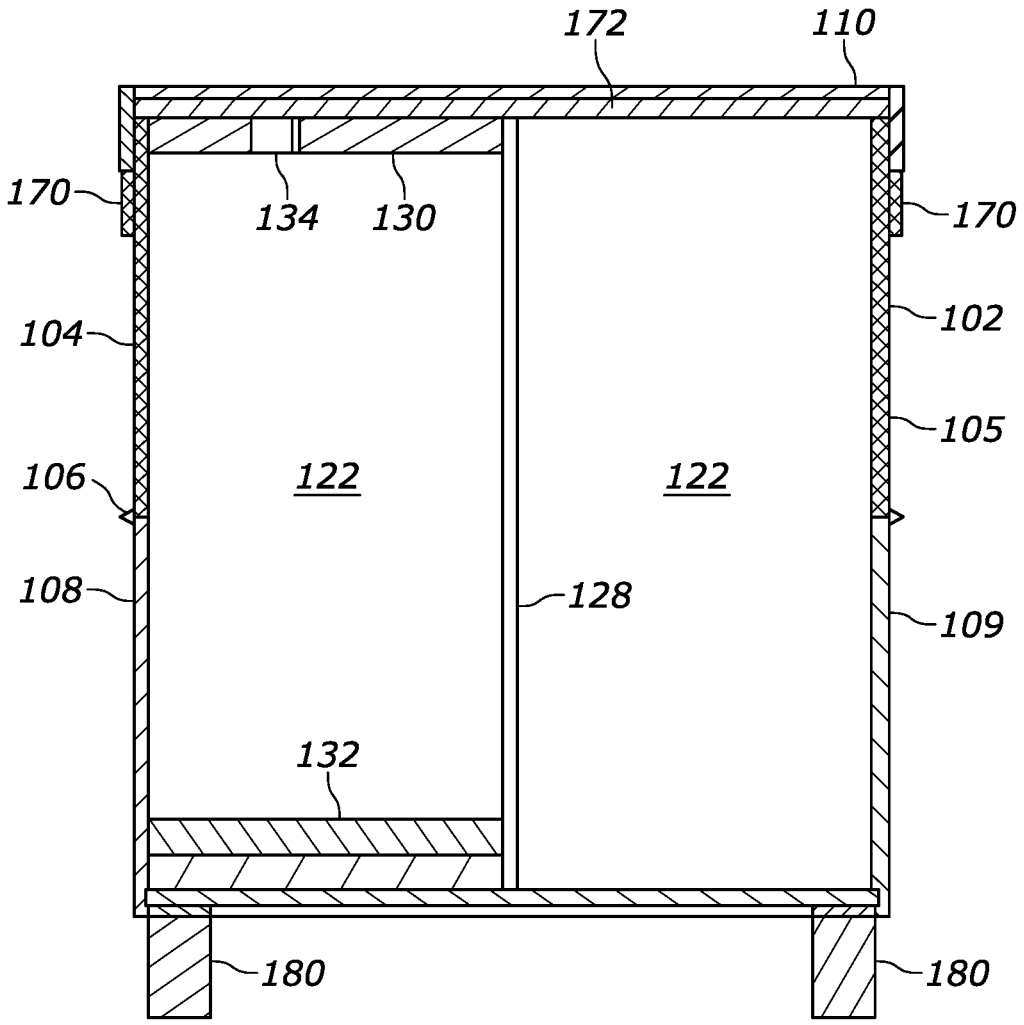
FIG. 16 is a cross-section view of the storage container of FIG. 1, in accordance with an example.
Figure 17:
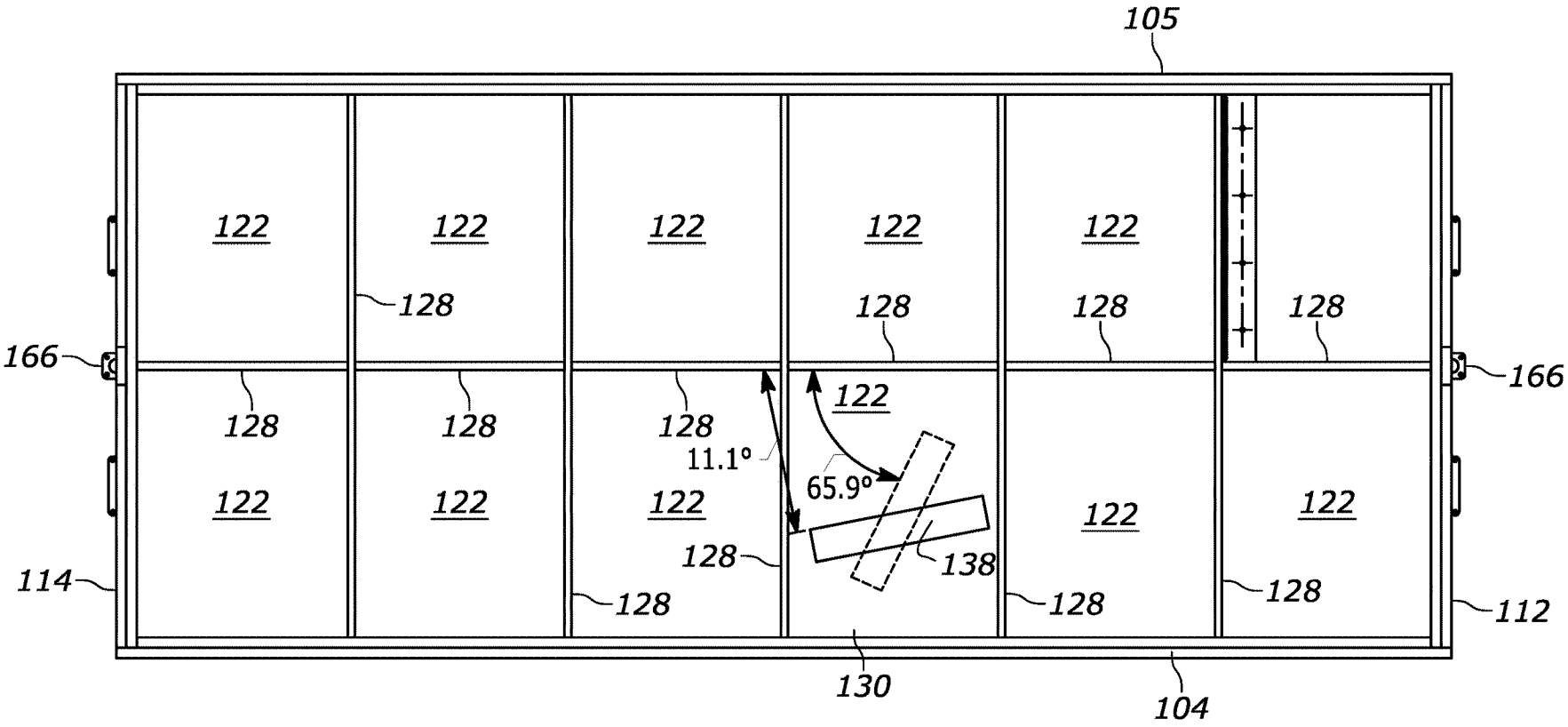
FIG. 17 is a top view of the storage container of FIG. 1 without the container lid and showing compartments, in accordance with an example.

FIGS. 14-17 illustrate an example implementation of the storage container 100 from different perspectives. FIG. 14 illustrates a side view of the storage container 100 showing the housing 102 with feet 180. FIG. 15 illustrates a bottom view of the storage container 100 showing the housing 102 and showing a bottom view of both the fixed retainer wall 108 (hinged to the movable retainer wall 104) on one side of the housing and the fixed retainer wall 109 (hinged to the movable retainer wall 105) on the other side. FIG. 16 illustrates a cross-sectional view of the storage container 100. FIG. 17 illustrates a top view of the storage container 100 with the container lid and blade tip retention holders removed, but showing a shadow indication of the orientation and angle of an example of the slot 134 versus an example of the slot 138.

Additional Aspects

Aspect 1. A storage container comprising:

a housing defining a plurality container rows, each row having a plurality of compartments each for housing a fan blade comprising a blade tip end and a blade root end, the plurality of container rows being parallel to one another and extending along a longitudinal axis of the storage container;

each of the plurality of compartments comprising compartment walls separating from the compartment from adjacent compartments, and each of the plurality of compartments having a first retention holder having a first receptacle slot shaped to retain the blade tip in place at a first end of the compartment and a second retention holder having a receptacle slot shaped to retain the blade root end in a second end of the compartment, wherein at least one of the first retention holder and the second retention holder is removable from the compartment, wherein each of the first retention holder and the second retention holder have a press fit against the compartment walls when retaining a fan blade in place and against lateral movement within the compartment and against twisting movement within the compartment;

the housing further comprising a plurality of retainer walls each spanning a respective container row and each movable between an access position allowing user access to insert and remove fan blades and retaining position block using access to insert and remove fan blades; and a container lid forming a press fit with the housing to retain the fan blades against transverse movement out of the housing during transportation of the storage container.

Aspect 2. The storage container of aspect 1, wherein the plurality of retainer walls are formed of a continuous wall member spanning the respective container row.

Aspect 3. The storage container of aspect 1, wherein the plurality of retainer walls are in a hinged configuration having one or more hinges allowing for movement between the access position and the retaining position.

Aspect 4. The storage container of aspect 3, wherein the plurality of retainer walls are flush with end walls of the housing when in the retaining position.

Aspect 5. The storage container of aspect 3, wherein the hinges are butterfly hinges.

Aspect 6. The storage container of aspect 3, wherein the hinges are magnetic hinges.

Aspect 7. The storage container of aspect 3, further comprising one or more latches to retain the plurality of retainer walls in the retaining position.

Aspect 8. The storage container of aspect 1, wherein the plurality of retainer walls each comprise a fixed wall extending transversely from the first end of the compartments and movable wall connected to the fixed wall and movable between the access position and the retaining position.

Aspect 9. The storage container of aspect 1, wherein the plurality of retainer walls are formed of a plurality of wall members spanning the respective container row.

Aspect 10. The storage container of aspect 1, wherein each of the first retention holder and the second retention holder are formed of a dense foam.

Aspect 11. The storage container of aspect 1, wherein the receptacle slot of the first retention holder extends the transverse length of the first retention holder and the receptacle slot of the second retention holder extends the transverse length of the second retention holder.

Aspect 12. The storage container of aspect 1, wherein the receptacle slot of the first retention holder partially extends the transverse length of the first retention holder and is capped with a stopping wall of the first retention holder and the receptacle slot of the second retention holder partially extends the transverse length of the second retention holder and is capped with a stopping wall of the second retention holder.

Aspect 13. The storage container of aspect 1, wherein the respective first retention holder and second retention holders in compartments within a container row are positioned to retain the respective fan blades in substantially the same orientation.

Aspect 14. The storage container of aspect 1, wherein the respective first retention holder and second retention holders in the plurality of containers row are positioned to retain the respective fan blades in substantially the same orientation in the storage container.

Aspect 15. The storage container of aspect 1, wherein both the first retention holder and the second retention holder are removable from compartment.

Aspect 16. The storage container of aspect 1, further comprising one or more container lid latches to retain the container lid in engagement against the housing.

Aspect 17. The storage container of aspect 1, wherein the container lid forms the press fit with the housing by forming the press fit with end walls of the housing.

Aspect 18. The storage container of aspect 17, wherein the container lid has a spacing gap to the plurality of retainer walls.

Aspect 19. The storage container of aspect 17, wherein the container lid comprises an deformable insert layer contacting an upper edge of the compartment walls.

Aspect 20. The storage container of aspect 1, wherein the compartment walls and the plurality of retainer walls are formed of % inch plywood or other composite materials.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

Those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding; and no unnecessary limitations should be understood therefrom, as modifications within the scope of the invention may be apparent to those having ordinary skill in the art.

What is claimed:

1. A storage container comprising:

a housing defining a plurality of container rows, each row having a plurality of compartments each for housing a fan blade comprising a blade tip end and a blade root end, the plurality of container rows being parallel to one another and extending along a longitudinal axis of the storage container;

each of the plurality of compartments comprising at least one compartment wall separating the compartment from an adjacent compartment, and each of the plurality of compartments having a first retention holder having a receptacle slot shaped to retain the blade tip in place at a first end of the compartment and a second retention holder having a receptacle slot shaped to retain the blade root end in a second end of the compartment, wherein at least one of the first retention holder and the second retention holder is removable from the respective compartment, wherein each of the first retention holder and the second retention holder has a press fit against the respective compartment walls when retaining a fan blade in place and against lateral movement within the compartment and against twisting movement within the compartment;

the housing further comprising a plurality of retainer walls each spanning a respective container row and each movable between an access position allowing user access to insert and remove fan blades and a retaining position blocking user access to insert and remove fan blades; and a container lid forming a press fit with the housing to retain the fan blade against transverse movement out of the housing during transportation of the storage container.

2. The storage container of claim 1, wherein the plurality of retainer walls are each formed of a continuous wall member spanning the respective container row.

3. The storage container of claim 1, wherein the plurality of retainer walls are in a hinged configuration having one or more hinges allowing for movement between the access position and the retaining position.

4. The storage container of claim 3, wherein the plurality of retainer walls are flush with end walls of the housing when in the retaining position.

5. The storage container of claim 3, wherein the hinges are butterfly hinges.

6. The storage container of claim 3, wherein the hinges are magnetic hinges.

7. The storage container of claim 3, further comprising one or more latches to retain the plurality of retainer walls in the retaining position.

8. The storage container of claim 1, wherein the plurality of retainer walls each comprise a fixed wall extending transversely from the first end of the compartments and a movable wall connected to the fixed wall and movable between the access position and the retaining position.

9. The storage container of claim 1, wherein the plurality of retainer walls are formed of a plurality of wall members spanning the respective container row.

10. The storage container of claim 1, wherein each of the first retention holder and the second retention holder is formed of a dense foam.

11. The storage container of claim 1, wherein the receptacle slot of the first retention holder partially extends a transverse length of the first retention holder and the receptacle slot of the second retention holder partially extends a transverse length of the second retention holder.

12. The storage container of claim 1, wherein the receptacle slot of the first retention holder partially extends the transverse length of the first retention holder and is capped with a stopping wall of the first retention holder and the receptacle slot of the second retention holder partially extends the transverse length of the second retention holder and is capped with a stopping wall of the second retention holder.

13. The storage container of claim 1, wherein the respective first retention holder and the respective second retention holder in respective compartments within a respective container row are positioned to retain the respective fan blades in substantially the same orientation.

14. The storage container of claim 1, wherein the respective first retention holder and the respective second retention holder in the plurality of container rows are positioned to retain the respective fan blades in substantially the same orientation in the storage container.

15. The storage container of claim 1, wherein both the first retention holder and the second retention holder are removable from the respective compartment.

16. The storage container of claim 1, further comprising one or more container lid latches to retain the container lid in engagement against the housing.

17. The storage container of claim 1, wherein the container lid forms the press fit with the housing by forming the press fit with end walls of the housing.

18. The storage container of claim 17, wherein there is a spacing gap between the container lid and the plurality of retainer walls.

19. The storage container of claim 17, wherein the container lid comprises a deformable insert layer contacting an upper edge of the compartment walls.

20. The storage container of claim 1, wherein the compartment walls and the plurality of retainer walls are formed of a composite material.

* * * * *